United States Patent [19]

Ash

[11] 4,182,317

[45] Jan. 8, 1980

[54] OBJECT DISLODGING METHOD AND APPARATUS

[76] Inventor: Paul M. Ash, 33 E. Tilden Dr., Brownsburg, Ind. 46112

[21] Appl. No.: 860,450

[22] Filed: Dec. 14, 1977

Related U.S. Application Data

[63] Continuation-in-part of Ser. No. 741,786, Nov. 15, 1976, abandoned.

[51] Int. Cl.[2] ..... A61H 31/00

[52] U.S. Cl. ..... 128/28; 128/60

[58] Field of Search ..... 128/1 R, 28, 54, 60, 128/303 R

[56] References Cited

U.S. PATENT DOCUMENTS

| | | | |
|---|---|---|---|
| 793,527 | 6/1905 | King | 128/60 |
| 1,026,480 | 5/1912 | Ward | 128/60 |
| 1,026,481 | 5/1912 | Ward | 128/60 |
| 3,401,686 | 9/1968 | Edwards | 128/28 |
| 4,059,099 | 11/1977 | Davis | 128/28 |

*Primary Examiner*—William E. Kamm

*Attorney, Agent, or Firm*—Woodard, Weikart, Emhardt & Naughton

[57] ABSTRACT

An object dislodging apparatus includes a dumbbell-shaped member having an enlarged, cylindrical portion at one end and a similarly shaped enlarged, cylindrical portion at the opposite end, and a section of pipe joining the two portions together. With the end of one cylindrical portion placed against the abdomen, directly beneath the diaphragm, and the opposite cylindrical portion grasped with both hands, the user is able to perform a modified type of Heimlich Maneuver by pulling inwardly on the apparatus with a quick, forceful thrust.

14 Claims, 8 Drawing Figures

OBJECT DISLODGING METHOD AND APPARATUS

CROSS REFERENCE TO RELATED APPLICATIONS

This application is a continuation-in-part application of my co-pending application, Ser. No. 741,786 filed Nov. 15, 1976, now abandoned.

BACKGROUND OF THE INVENTION

This invention relates in general to object dislodging apparata and in particular to apparata suitable for performing a modified type of Heimlich Maneuver.

Every year thousands of persons die due to choking on objects such as a bolus of food which has become lodged in their throats. For many years there was almost no solution to such occurrences which were often confused with a heart attack and by the time medical personnel arrived, it was too late to save the victim.

Recently, Dr. Henry J. Heimlich described a maneuver in the June, 1974 issue of *Emergency Medicine* in an article entitled "Pop Goes the Cafe Coronary." The Heimlich Maneuver, as it is referred to, causes a sudden, forceful compression of the lungs which results in an increase to the air pressure within the trachea and ejects the offending object which is stuck in the throat. In order to perform the maneuver, the person who is aiding the victim must stand behind the victim, making a fist with one hand and grabbing the fist with the other hand. With the fist placed above the navel and below the rib cage, the fist is pressed into the victim's upper abdomen with a quick, upward thrust which may be repeated several times, if necessary, in order to free the stuck object.

Of course, one requirement to a successful performance of the Heimlich Maneuver is that there be a person in the vicinity of the victim who is physically able to perform the required steps. Unfortunately, a significant percentage of the choking deaths occur in the privacy of one's home where the victim either lives alone or is alone at the time the object becomes stuck in the throat. It is suggested that even for persons who are alone, a modified type of Heimlich Maneuver can be used by the victim by pressing his own abdomen into the corner of the table or sink or by using his own fist to force air from the lungs. However, these types of modifications are likely not as effective as the actual Heimlich Maneuver because the victim does not have the same type of leverage with his own fist as a person standing behind the victim has. Furthermore, a suitably shaped and properly elevated table or sink corner may not always be available and if available, this solo maneuver requires a greater degree of physical exertion in order to propel the entire body into the corner so that sufficient thrust is created to dislodge the object which is stuck.

There are other devices which have been used to assist victims of such problems as food strangulation. One such device is a "ChokeSaver" offered by DYNAMED of Leucadia, Calif. The "ChokeSaver" is a large plastic tweezer designed to slip down the victim's throat and grasp the blocking food. The steps required for proper use of the "ChokeSaver" require the assistance of someone other than the victim and thus such a device is not suitable for persons living alone or for persons who happen to be alone at the time the choking occurs.

There are also medical procedures for establishing an emergency breathing path for patients experiencing upper respiratory obstructions. A variety of tracheotomy or cricothyrotomy tubes have been used for insertion into the victim's windpipe beneath the area of obstruction. In addition to the fact that these types of procedures require someome other than the victim to perform the various steps, the surgical nature of the procedure suggests that some type of medical personnel should be present in order to either perform or direct the performance of the various steps.

There are still further devices and apparata for use with the body such as those disclosed in U.S. Pat. No. 3,858,579, issued Jan. 7, 1975 to Ching and U.S. Pat. No. 4,002,163 issued Jan. 11, 1977 to Jackson, Jr. These two devices, although possibly usable for a variety of functions, are particularly designed and constructed to be used as massaging and exercising apparata for the human body.

SUMMARY OF THE INVENTION

An object dislodging apparatus according to one embodiment of the present invention comprises a dumbbell-shaped member having an enlarged portion at one end and a similarly shaped enlarged portion at the opposite end, the enlarged portions being joined together by a connecting member. Each enlarged portion is sized and contoured so that either portion will fit against the user's abdomen directly beneath the diaphragm. The apparatus has an overall length such that with one of the enlarged portions positioned against the anatomy and substantially perpendicular thereto, the hands of the user are able to grasp the outermost end of the other enlarged portion.

One object of the present invention is to provide an improved object dislodging apparatus for freeing objects which are stuck in the throat.

Another object of the present invention is to provide an improved method of dislodging objects by a victim which are stuck in the victim's throat.

Related objects and advantages of the present invention will be apparent from the following description.

DESCRIPTION OF THE PREFERRED EMBODIMENT

Figure 1:
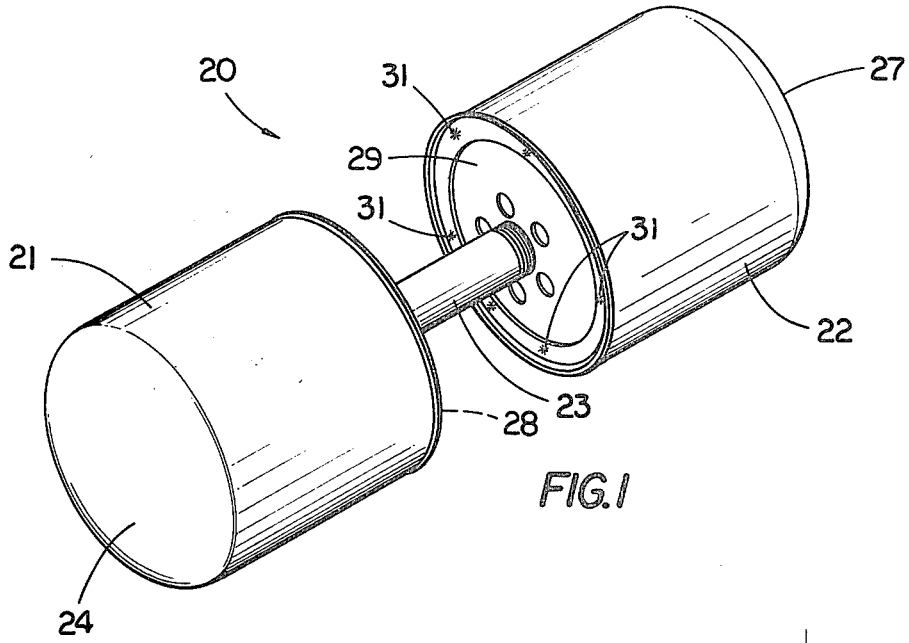
FIG. 1 is a perspective view of a dislodging apparatus according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, object dislodging apparatus 20 is shown as a dumbbell-shaped member having enlarged portions 21 and 22 at opposite ends and these two enlarged portions are connected by a smaller tubular connecting member 23. Each enlarged portion 21 and 22 is of a generally cylindrical shape with outermost ends 24 and 27 being slightly rounded or dome-shaped in appearance. Connecting member 23 is securely joined to generally flat ends 28 and 29 and the longitudinal axis of connecting member 23 is substantially coincident with the cylindrical axis of enlarged portions 21 and 22. Each enlarged portion 21 and 22 is approximately 3.75 inches in overall length from flat end 28 (or 29) to outermost end 24 (or 27), and the generally cylindrical body portion of each enlarged portion 21 and 22 is approximately 3.5 inches in outside diameter. This diameter size is sufficient to avoid interference with ribs of the victim's rib cage at the location beneath the diaphragm as will be discussed in greater detail hereinafter. The overall length of dislodging apparatus 20 from outermost end 24 to the opposite outermost end 27 is approximately 12.25 inches.

Figure 2A:
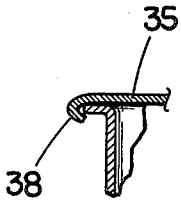
FIG. 2*a* is an enlarged partial section view of a canister body and cover taken along line 2*a*—2*a* in FIG. 2.
Figure 3:
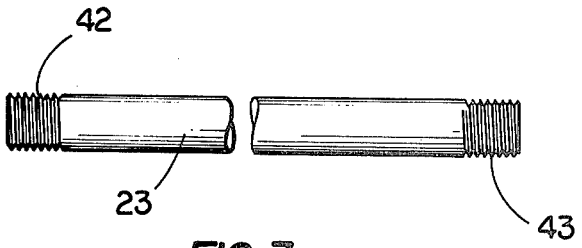
FIG. 3 is a plan view of a connecting member comprising a portion of the FIG. 1 apparatus.
Figure 2:
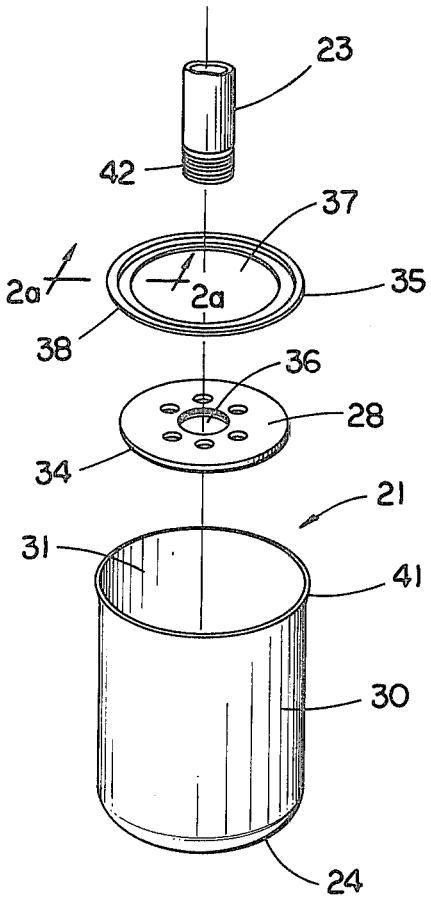
FIG. 2 is an exploded view of a portion of the FIG. 1 apparatus.

Enlarged portions 21 and 22 are constructed virtually identically to one another and the following detailed description of enlarged portion 21 is to be understood to be equally descriptive for enlarged portion 22. Enlarged portion 21 (see FIG. 2) includes a canister body 30 which is a single, deep drawn piece of metal, such as, for example, aluminum, which is seamless and enclosed along outermost end 24 with opposite end 31 being open. Canister body 30 is a hollow, cylindrical, thin-walled member and as such is suitable for such a deep drawing fabrication operation. In order to construct flat end 28 two additional members are joined to canister body 30. These two additional members are internally threaded collar 34 and retaining cover 35. Collar 34 and cover 35 are both generally circular in shape and are spot welded to each other at points 31 to form a single member. FIG. 2 illustrates collar 34 and cover 35 in a separated condition prior to spot welding at points 31. The internally threaded opening 36 of collar 34 and the opening 37 of cover 35 being generally coincident to each other in this welded-together assembly. Collar 34 is approximately 3.37 inches in outside diameter and will therefore slip within end 31 of canister body 30. Cover 35 is approximately 4.0 inches in outside diameter and thus includes sufficient extra material along its outer periphery which is rolled into a depending circular lip 38. Similarly, the outer edge 41 of canister body 30 is slightly flared in an outwardly direction so that depending circular lip 38 will fit snugly around flared outer edge 41 so that canister body 30 and retaining cover 35 may be roll-seamed, crimped and/or seam welded together, creating a solid, single rigid member (see FIG. 2*a*). One consideration with enlarged portion 21 as well as dislodging apparatus 20 is the overall weight of the apparatus. However, the overall weight must be balanced against strength and durability requirements for the apparatus. Therefore, since collar 34 must have sufficient material thickness to be internally threaded with a suitable number of threads to accept connecting member 23, the weight of collar 34 is reduced by drilling a circular pattern of six 0.25 inch diameter holes through the collar.

Connecting member 23 is approximately 4.5 inches in length and is externally threaded on ends 42 and 43. Externally threaded end 42 is received by internally threaded opening 36 of collar 34 while externally threaded end 43 will be similarly received by the corresponding collar of enlarged portion 22. Although a variety of shapes and materials are suitable for connecting member 23, a section of pipe is preferred due to its strength and machinability. Ends 42 and 43 are threaded with tapered pipe threads so that as each end is threadedly engaged with its corresponding collar member, the depth into threaded opening 36 is controlled and the spacing between enlarged portions 21 and 22 is set.

Figure 4:
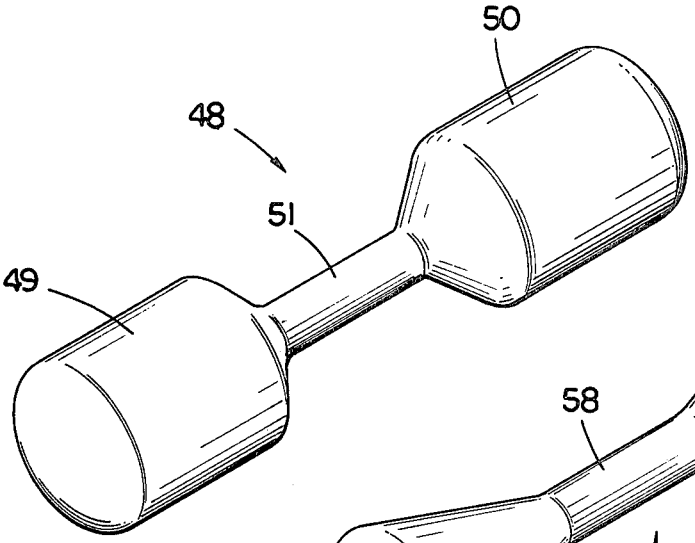
FIG. 4 is a perspective view of an alternatively shaped object dislodging apparatus according to the present invention.
Figure 5:
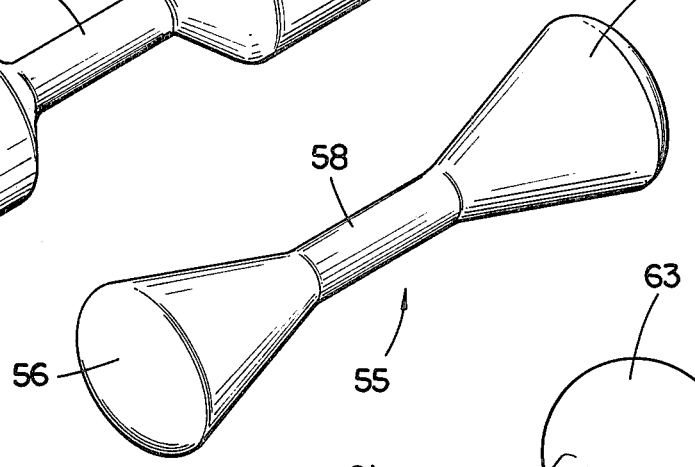
FIG. 5 is a perspective view of an alternatively shaped object dislodging apparatus according to the present invention.
Figure 6:
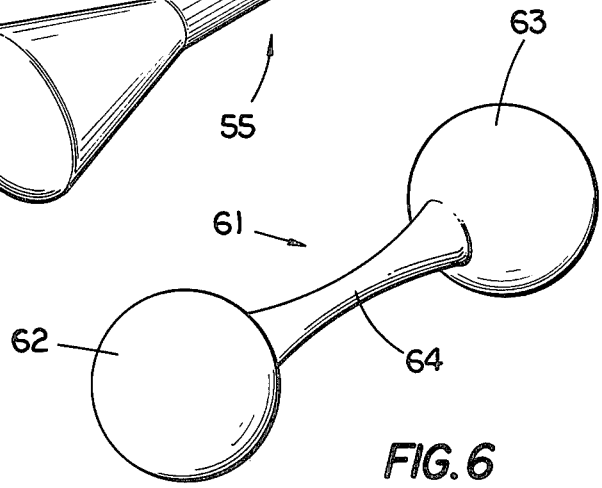
FIG. 6 is a perspective view of an alternatively shaped object dislodging apparatus according to the present invention.

The design of dislodging apparatus 20, although including several individual pieces for its fabrication, represents a fairly basic construction and requires a minimum of fabrication steps. Canister body, for example, may be the can portion of a conventional automobile oil filter, and once collar 34 and cover 35 are cut and bored, the only fabrication steps remaining are the spot welding and seam welding. It is, however, possible to construct a similar dislodging apparatus of a single piece, molded plastic construction from one of various thermosetting or thermoforming compounds. Examples of such single piece molded dislodging apparata are shown by FIGS. 4, 5 and 6. Each of these alternatively shaped dislodging apparata have enlarged end portions which taper to a connecting member therebetween. Dislodging apparatus 48, which includes generally cylindrical enlarged portions 49 and 50, represents a shape which is similar to apparatus 20 and to the cylindrical shape of cannister body 30. The outermost surfaces of end portions 49 and 50 are rounded or dome-shaped for a comfortable fit against the victim's abdomen as will be described hereinafter. The opposite end of each end portion 49 and 50 tapers inwardly with a type of conical shape to its point of connection with connecting member 51. Although it is possible for connecting member 51 to be a separate piece and joined by either adhesive or mechanical fasteners to end portions 49 and 50; as previously mentioned, the preferred construction is for the entire apparatus to be molded into a single piece construction. Apparatus 55 also of a single piece, molded plastic construction has conically shaped end portions 56 and 57 which are joined together by connecting member 58. A third alternatively shaped dislodging apparatus 61, as illustrated in FIG. 6, includes spherically shaped end portions 62 and 63 and a connecting member 64 therebetween. The alternative shapes illustrated by FIGS. 4, 5 and 6 are all equally suitable as dislodging apparata and the various shapes merely suggest variations in mold design which are possible. It may be that a particular end portion shape is preferred for a victim of a certain size and age, covering the range of from small children to the elderly, and that certain end portion designs are more comfortable to certain individuals, depending upon the structure and shape of their individual anatomy. The three-piece construction shown and described above may be advantageous in some instances for packing in a suitcase, as the pipe can be unscrewed from both ends, if desired.

Figure 7:
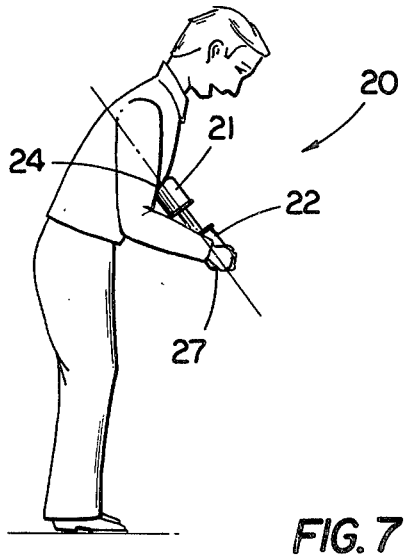
FIG. 7 is a perspective view of the FIG. 1 apparatus as it would be positioned relative to a choking victim.

The use of dislodging apparata 20, 48, 55 or 61 is illustrated in FIG. 7 wherein the choking victim, who has an object or bolus of food caught in his throat, places one enlarged end portion, for example, enlarged portion 21, against his abdomen directly beneath the diaphragm. This location may also be described as being slightly above the navel and below the sternum of the rib cage. With enlaged portion 21 placed snugly against the abdomen as described, the remainder of apparatus 20 extends outwardly in a substantially perpendicular direction relative to the surface of the abdomen. The choking victim then grasps the outermost end 27 of the opposite enlarged portion 22 with both hands. The choking victim then pulls inwardly and upwardly toward his shoulder blades, on outermost end 27 with a quick, forceful thrust, jamming the outermost end 24 sharply into the abdomen. With this quick, forceful upward thrust, a pulse wave of air from within the lungs is sent up through the throat and acts as a shock wave to dislodge the object or bolus of food which is stuck within the throat.

Apparata 20, 48, 55 and 61 provide a suitable apparata for simulation of the Heimlich Maneuver such that the advantages of that technique can be made available to victims who are alone at the time the object is lodged within their throat and they begin choking. The various apparata are each relatively small and lightweight so that they are convenient for carrying and storage and could be made readily available in almost any surrounding.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An object dislodging apparatus for objects stuck in a throat which comprises:

a dumbbell-shaped member having an enlarged portion at one end and a similarly shaped enlarged portion at the opposite end, said enlarged portions being joined together by a connecting member;

each of said enlarged portions having a generally circular outer end shape and a diameter size sufficient to avoid rib cage interference when placed against the user's abdomen at a location directly beneath the user's diaghragm; and said apparatus having an overall length such that with one of said enlarged portions positioned against said abdomen and substantially perpendicular thereto, the hands of said user are able to be clasped together over the outermost end of the other enlarged portion.

2. The dislodging apparatus of claim 1 wherein each of said enlarged portions includes a hollow, cylindrical, thin-walled canister body member open at one end and rounded at the opposite end, an end cover having a rolled lip overhanging the edge of said one end, said rolled lip being seam welded to said canister body member and a support plate spot welded to said end cover and positioned between said canister body member and said end cover.

3. The dislodging apparatus of claim 2 wherein said support plate is internally threaded and said connecting member is a section of pipe externally threaded at opposite ends so as to engage each of said internally threaded support plates.

4. The dislodging apparatus of claim 2 wherein the outside diameter of each canister body member is from 2.5 to 4.5 inches.

5. The dislodging apparatus of claim 4 wherein the overall length of said apparatus, from the enclosed, rounded end of one canister body member to the opposite, enclosed rounded end of the other canister body member is from 10 to 14 inches.

6. The dislodging apparatus of claim 1 wherein the total weight of said apparatus is from one to two pounds.

7. The dislodging apparatus of claim 6 wherein each of said enlarged portions is a canister having a body member constructed of a single piece of aluminum.

8. The dislodging apparatus of claim 1 wherein said apparatus is of a single piece, molded plastic construction.

9. The dislodging apparatus of claim 8 wherein each of said enlarged portions has a conical shape, tapering toward said connecting member.

10. The dislodging apparatus of claim 9 wherein the total weight of said apparatus is from one-half to one pound and the overall length is from 10 to 14 inches.

11. The dislodging apparatus of claim 8 wherein each of said enlarged portions has a spherical shape, tapering toward said connecting member.

12. The dislodging apparatus of claim 11 wherein the total weight of said apparatus is from one-half to one pound and the overall length is from 10 to 14 inches.

13. A method of using an object dislodging apparatus of a dumbbell shape having oppositely disposed enlarged end portions by a victim in order to dislodge objects which are stuck in the victim's throat comprising the steps of:

(a) placing one of said enlarged end portions of said apparatus against the abdomen of the victim at a location directly beneath the diaphragm;

(b) clasping the hands over the other enlarged end portion of said apparatus and applying pressure against the abdomen by said one end portion;

(c) orienting the apparatus so that it extends outwardly in a direction substantially perpendicular to the abdomen;

(d) pulling inwardly with said clasped hands on the other enlarged end portion of the apparatus with a quick forceful thrust so as to cause a pulse wave of air to be sent up the throat and cause the stuck object to be dislodged.

14. The method of claim 13 wherein:

the pulling by the victim is toward the victim's shoulder blades.

* * * * *